US010612205B2

(12) United States Patent
Lindeman et al.

(10) Patent No.: US 10,612,205 B2
(45) **Date of Patent: *Apr. 7, 2020**

(54) HAMMERING DEVICE MEANT FOR HAMMERING POLES INTO THE GROUND

(71) Applicants: Mikko Lindeman, Hameenlinna (FI); Pentti Kuivamaki, Hyvinkaa (FI)

(72) Inventors: Mikko Lindeman, Hameenlinna (FI); Pentti Kuivamaki, Hyvinkaa (FI)

(73) Assignee: MOVAX OY (FI)

( * ) Notice: Subject to any disclaimer, the term of this patent is extended or adjusted under 35 U.S.C. 154(b) by 226 days.

This patent is subject to a terminal disclaimer.

(21) Appl. No.: 15/673,892

(22) Filed: Aug. 10, 2017

(65) Prior Publication Data

US 2017/0335538 A1 Nov. 23, 2017

Related U.S. Application Data

(63) Continuation of application No. 14/374,237, filed as application No. PCT/FI2013/000002 on Jan. 28, 2013, now Pat. No. 9,765,496.

(30) Foreign Application Priority Data

Jan. 27, 2012 (FI) ..... 20120026

(51) Int. Cl.
*E02D 7/18* (2006.01)
*E02D 13/00* (2006.01)

(52) U.S. Cl.
CPC ..... *E02D 7/18* (2013.01); *E02D 13/00* (2013.01)

(58) Field of Classification Search
USPC ..... 173/49, 184; 408/232
See application file for complete search history.

(56) References Cited

U.S. PATENT DOCUMENTS

| | | | | |
|---|---|---|---|---|
| 3,386,726 | A | 6/1968 | Lorenz | |
| 3,737,157 | A | 6/1973 | Kiwalle | |
| 4,366,606 | A * | 1/1983 | Willis | E21B 19/06 269/218 |
| 4,403,897 | A | 9/1983 | Willis | |
| 7,036,396 | B2 * | 5/2006 | Moe | E21B 19/168 81/57.2 |
| 7,197,963 | B1 * | 4/2007 | Flud | B25B 5/061 81/57.19 |

(Continued)

FOREIGN PATENT DOCUMENTS

| | | |
|---|---|---|
| EP | 2003252 | 12/2008 |
| FI | 106219 | 12/2000 |

(Continued)

*Primary Examiner* — Nathaniel C Chukwurah
(74) *Attorney, Agent, or Firm* — Galbreath Law Office, P.C.; John A. Galbreath

(57) ABSTRACT

Hammering device for hammering elongated objects into the ground. The hammering device comprises a body (1) attachable to a power tool, a vibrator device (6) attached to the body (1) with damping cushions (9), and movable gripping jaws (10) for gripping the object to be hammered, the movable gripping jaws (10) comprising gripping elements (23). The movable gripping jaws (10) are attached to the vibrator device (6) with detachable pins (20, 21) that form pivots (8) and the gripping jaws (10) are located on top of and underneath the vibrator device (6).

12 Claims, 3 Drawing Sheets

(56) References Cited

U.S. PATENT DOCUMENTS

| | | | | |
|---|---|---|---|---|
| 9,765,496 | B2 * | 9/2017 | Lindeman | E02D 13/00 |
| 2007/0068345 | A1 | 3/2007 | Flud | |
| 2008/0310923 | A1 * | 12/2008 | Jinnings | E02D 11/00<br>405/232 |

FOREIGN PATENT DOCUMENTS

| | | |
|---|---|---|
| FI | 20100158 | 9/2011 |
| GB | 2358035 | 7/2001 |
| JP | H1030346 | 2/1998 |
| JP | 2008-190282 | 8/2008 |
| RU | 2010918 | 4/1994 |
| SU | 1441025 | 11/1988 |
| SU | 1636523 | 3/1991 |
| WO | WO 2011/1318244 | 10/2011 |

* cited by examiner

HAMMERING DEVICE MEANT FOR HAMMERING POLES INTO THE GROUND

The invention relates to a hammering device which is meant for hammering poles, steel profiles and other elongated objects into the ground which device comprises a body which can be attached to a power tool, a vibrator device which is attached to the body with the help of damping cushions and movable gripping jaws which are adjusted to the mentioned vibrator device for gripping the object to be hammered at least with a side grip in which case the gripping elements of the gripping jaws can be brought closer and farther away with the help of a regulating unit, such as a hydraulic cylinder.

Hammering devices according to the above mentioned preamble are previously known in which hammering devices the vibrator device and another body are attached to the body of the hammering device with the help of damping cushions in which case the another body partly surrounds the mentioned vibrator device. Gripping jaws are attached to the another body either to be stiff or to be turning with the help of a joint. A Finnish patent specification nr. 106219 can be mentioned as an example.

The disadvantage of these solutions is the fact that when the arms of both gripping jaws are turning, the piece to be compressed between them does not necessarily get settled symmetrically in relation to the jaws because the jaws can have a different turning angle when they reach the compression stage. If the jaw solution, in which one jaw is fixed and the other can be moved, is used, the piece which has been taken between them always gets settled against the fixed jaw and the position of the movable jaw depends on the thickness of the piece which has been gripped. Due to these both above mentioned matters at least one of the jaws possibly compresses the piece diagonally. This is easily the case when gripping pieces, which are formed according to the forms of the piece to be gripped, are used in the jaws.

In order to eliminate these disadvantages a new hammering device has been developed with which hammering device the above mentioned problems can be solved and the right, planned grip can be ensured for the jaws. It is characteristic of the invention that in order to maintain the mutual symmetry of the gripping jaws during their movement, the gripping jaws essentially comprise arms which are attached to be stiff at the location of their turning joints which arms are directed in such a way that the ends of the arms are located next to each other and essentially stay next to each other during the turning movements meant for the gripping jaws and that the ends of the mentioned arms are connected to each other with the help of a short arm which has a pivot mounting.

The advantage of the invention is the fact that the object which has been taken to the hammering device to be hammered is always located symmetrically in relation to the jaws in which case both jaws will have the same load. Further when one uses pieces of the jaw which are formed according to the object to be hammered, the invention ensures the fact that the mutual position of the pieces of the jaw and the object is the right one.

In the following the invention is described more detailed by referring to the accompanying drawings in which FIG. 1 shows a body of the hammering device.

Figure 1:
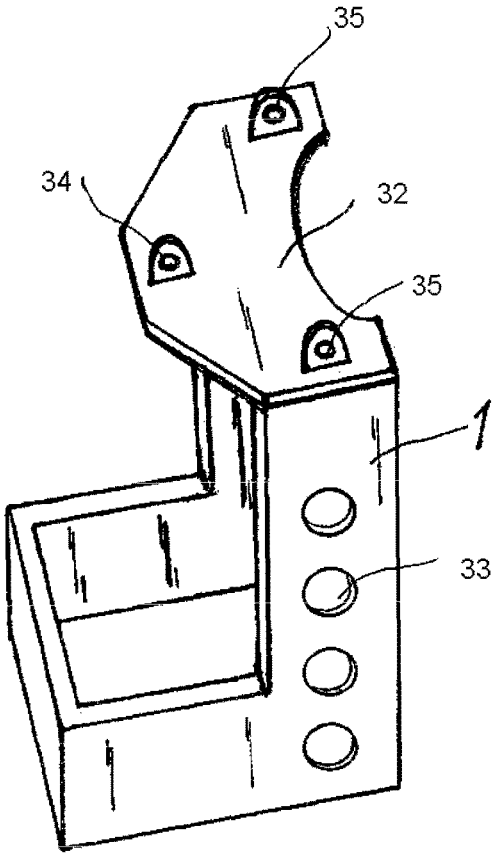

The body 1 of the hammering device according to the invention is shown in the FIG. 1 on top of which body there is an attachment plate 32 to the power tool, such as in order to attach the body to an excavator with the help of coupling elements 34, 35. There are gaps 33 in the body 1 into which gaps some parts of the damping cushions of the vibrator device are located in order to attach the vibrator device to this body with the help of the damping cushions.

Figure 2:
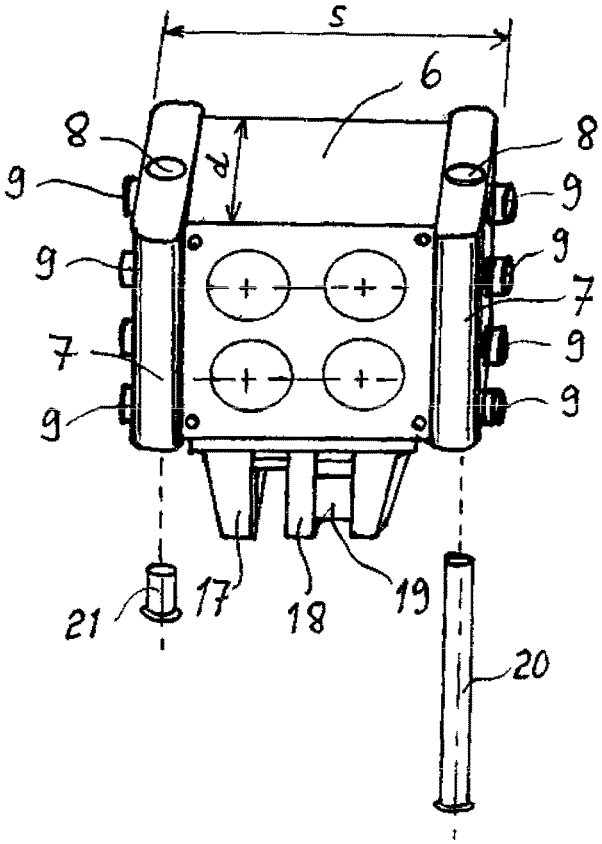
FIG. 2 shows a vibrator device which can be adjusted inside the body of the hammering device of the FIG. 1.

A vibrator device of the FIG. 2 which can be adjusted inside the body 1 and can easily be changed is shown in the FIG. 2 of which vibrator device it is characteristic that the measures stays constant even though the power category of the device changes. Several vibrator devices 6 of a different power category can thus be adjusted to the hammering device if one wants to have various hammering effects. The weights and the width d included in the vibrator device 6 can change when the power category changes.

Damping cushions 9 are attached to the sides of the vibrator device 6 as structural units 7 in which case these units 7 are attached to the sides of the vibrator device 6 to be easily opened. Gaps 8 have also been directed through these units 7 through which gaps the joint pins 20 or 21, which are related to the attachment of the gripping elements 10, can be adjusted. There is a jaw at the lower surface of the vibrator device 6 with which jaw one can hammer from the top of the pole or pull the pole up. The jaw comprises a fixed part 17, a movable part 18 and a cylinder 19 which moves the movable part 18.

Figure 3:
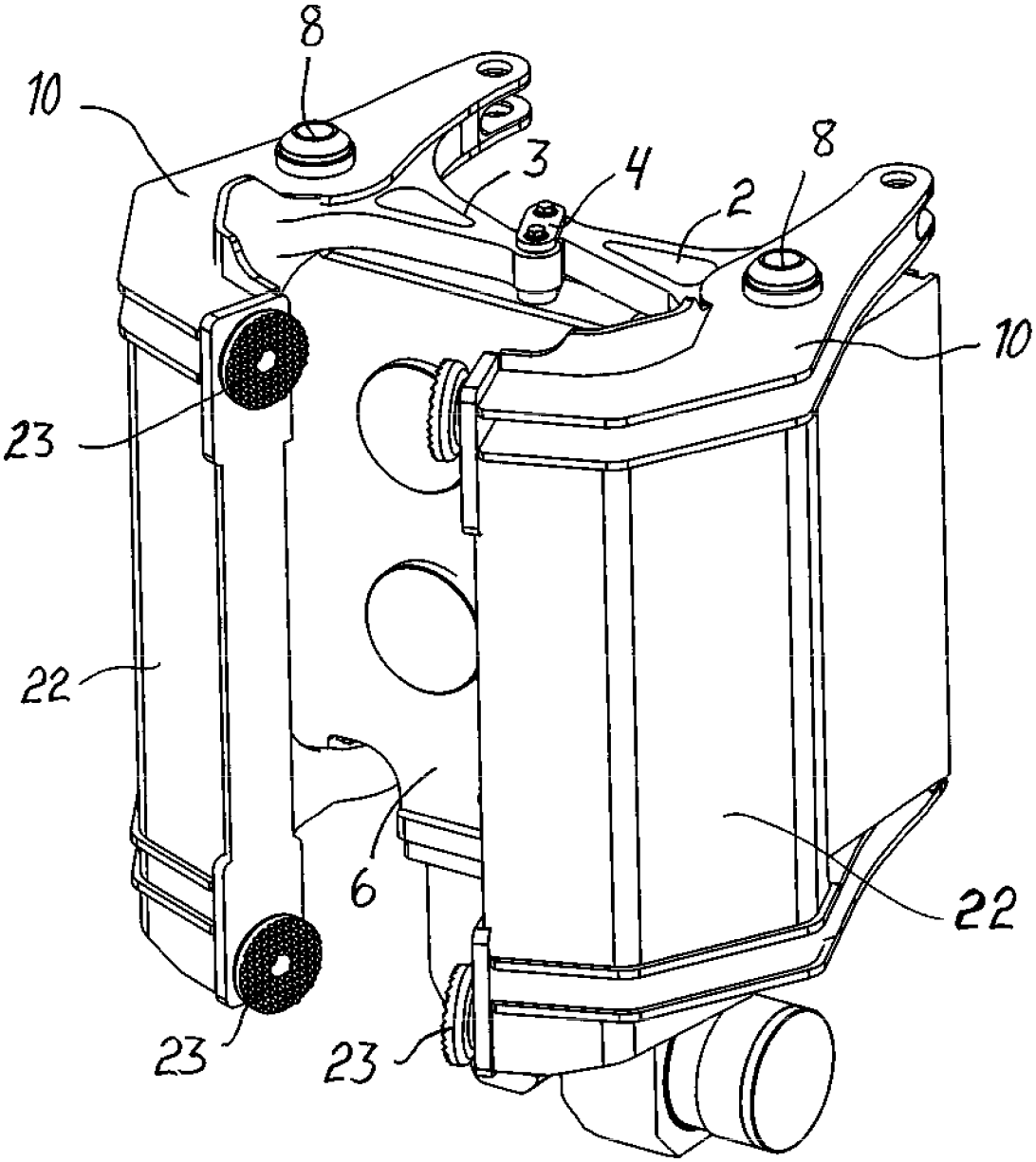
FIG. 3 shows a vibrator device diagonally seen which vibrator device comprises gripping jaws in position and they are connected to each other according to the invention.

A vibrator device 6 which can be located between the body 1 is shown in the FIG. 3 in which vibrator device the gripping jaws 10 are attached to the vibrator device 6 with the help of pins 20. The pins 20 come up by forming pivots 8. The gripping jaws 10 are located on top of the vibrator device 6 and underneath it. Upper and lower gripping jaws are connected to each other with the help of adapter plates 22 so that they function together. The gripping pieces 23 are attached to the gripping jaws 10. The gripping jaws 10 are connected with the help of an arrangement according to the invention which arrangement comprises arms 2, 3 which are attached in fixed way to the gripping jaws 10 and comprises joint points at the ends of the arms 2, 3 in such a way that the ends of the arms 2, 3 can be connected with the help of a short arm 4.

Figure 5:
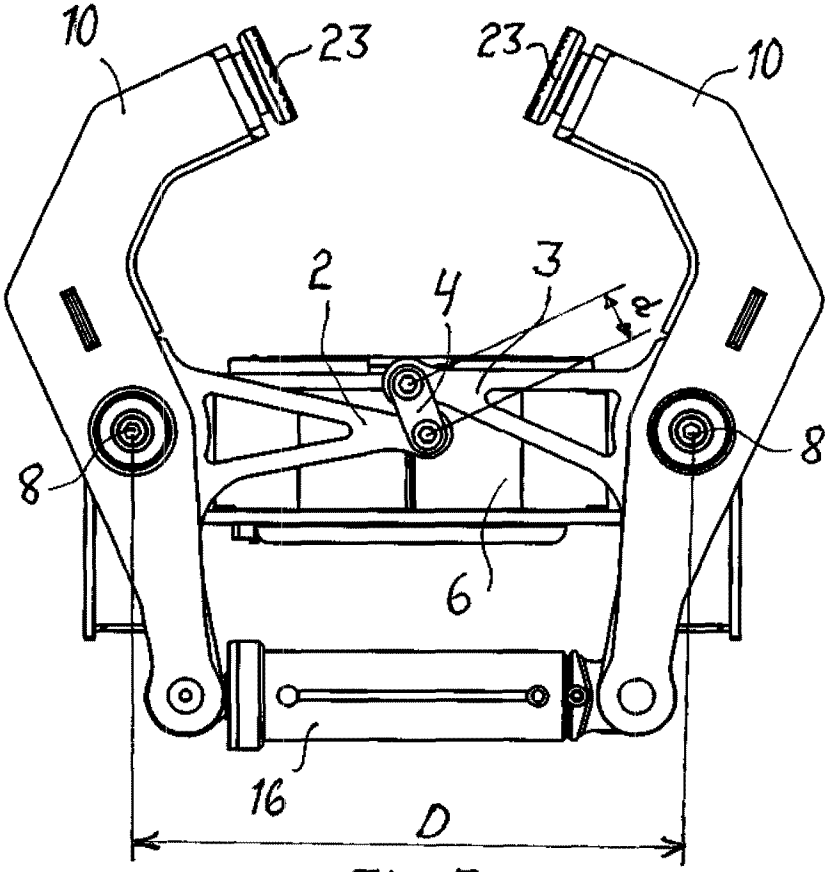
FIG. 5 shows gripping jaws when they have been moved into another position in relation to the FIG. 4.
Figure 4:
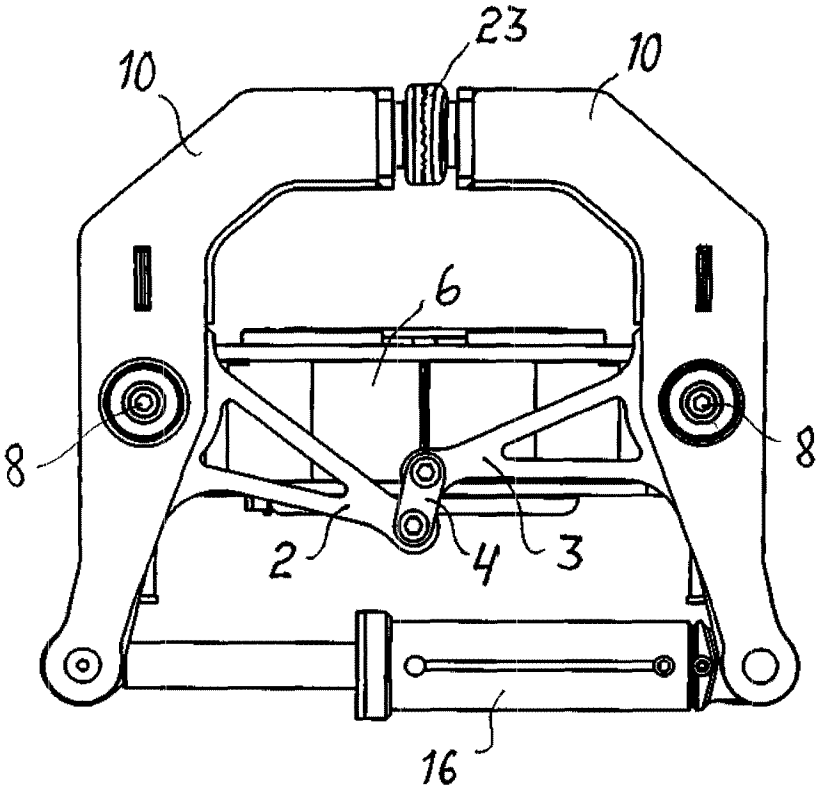
FIG. 4 shows an arrangement according to the invention which arrangement is attached to the gripping jaws seen from above.

The realization of the symmetrical movement of the gripping jaws 10 is shown in the FIGS. 4 and 5 with an arrangement according to the invention in which arrangement the arms 2 and 3 are located at the gripping jaws 10 in a fixed way and these arms are directed towards each other, but in such a way that in all symmetry stages of the gripping jaws 10 the ends of the arms 2, 3 are located next to each other and the arms 2, 3 are located partly interlocked in relation to each other. The ends of the arms 2, 3 are connected to each other with the help of a short arm 4 which is attached to the ends of the arms 2, 3 with the help of the joint pins. When gripping jaws 10 are being opened and closed, the short arm 4 moves and turns a little and keeps the gripping jaws 10 at the same time in a symmetry stage. The arms 2, 3 are located and turn at the same level and the arm 4 connecting their ends is short and the distance d of its pivots is under 20% compared to the distance D of the pivots 8 of the gripping jaws 10.

Both arms 2, 3 have separately such an open position in which it is being directed towards the turning joint 8 of an opposite gripping jaw 10. It is also advantageous that the arm 2, 3 has a shape of a triangle the base part of which arm is attached to the gripping jaw 10 essentially centrally in relation to the location of the turning joint 8.

The invention claimed is:

1. Hammering device for hammering elongated objects into the ground, the hammering device comprising a body attachable to a power tool, a vibrator device attached to the body with damping cushions, first and second opposing movable gripping jaws for gripping the object to be hammered, the movable gripping jaws comprising gripping elements, a first pinhole attachment comprising a detachable pin and a hole by which the first movable gripping jaws is attached to the vibrator device both below and above the vibration device, and a second pinhole attachment comprising a detachable pin and a hole by which the second movable gripping jaw is attached to the vibrator device both below and above the vibration device, wherein the first and second pinhole attachment mechanisms are openable by detaching the pins from the holes, the pins form pivots, and an upper part of the first or the second movable gripping jaw is connected to a lower part of the first or the second movable gripping jaw with an adapter plate.

2. The hammering device of claim 1, wherein the gripping elements can be brought closer and farther away with a regulating unit.

3. The hammering device of claim 2, wherein the regulating unit is a hydraulic cylinder.

4. The hammering device of claim 1, wherein the gripping jaws comprise arms, attached to the pivots of the gripping jaws.

5. The hammering device of claim 4, wherein the two arms are rigidly attached essentially to a location of pivots of the gripping jaws.

6. The hammering device of claim 4, wherein the two arms are directed in such a way that the ends of the two arms are located next to each other and stay essentially next to each other during the turning movements of gripping jaws, such that the ends of the two arms are connected to each other with a short arm having a first end and a second end pivotally mounted between the two arms.

7. The hammering device of claim 4, wherein the two arms are located next to each other and at the same time the two arms are located partly interlocked in relation to each other.

8. The hammering device of claim 4, wherein the two arms are located and turn essentially at the same level with the short arm connecting the two arms, wherein a distance of pivots of the short arm is less than 20% compared to a distance of the pivots of the gripping jaws.

9. The hammering device of claim 4, wherein each of the two arms is directed towards both the pivots when the gripping jaws are in an open position.

10. The hammering device of claim 4, wherein each of the two arms has a shape of a triangle, wherein each of the two arms is attached to one of the gripping jaws such that both the pivots are arranged essentially centrally in relation to a side of one the two arms.

11. The hammering device of claim 1, wherein the movable gripping jaws are configured to grip the object to be hammered at least with a side grip.

12. The hammering device of claim 1, wherein damping cushions are attached to the sides of the vibrator device as structural units.

* * * * *